US008620190B2

(12) United States Patent
Kikuchi et al.

(10) Patent No.: US 8,620,190 B2
(45) Date of Patent: Dec. 31, 2013

(54) DEVELOPING APPARATUS AND IMAGE FORMING APPARATUS INCLUDING THE SAME

(75) Inventors: Susumu Kikuchi, Yokohama (JP); Toshifumi Hashimoto, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 12/975,693

(22) Filed: Dec. 22, 2010

(65) Prior Publication Data

US 2011/0158699 A1 Jun. 30, 2011

(30) Foreign Application Priority Data

Dec. 25, 2009 (JP) ..... 2009-295940
Jul. 19, 2010 (KR) ..... 10-2010-0069607

(51) Int. Cl.
*G03G 15/08* (2006.01)

(52) U.S. Cl.
USPC ..... 399/254; 399/256

(58) Field of Classification Search
USPC ..... 399/254, 255, 256, 258
See application file for complete search history.

(56) References Cited

U.S. PATENT DOCUMENTS 4,864,349 A * 9/1989 Ito ..... 399/256
5,722,002 A * 2/1998 Kikuta et al. ..... 399/256 X
7,580,657 B2 * 8/2009 Tateyama et al. ..... 399/256
7,783,233 B2 * 8/2010 Iwata et al. ..... 399/256
7,792,465 B2 * 9/2010 Kubo et al. ..... 399/254
7,835,653 B2 * 11/2010 Katoh et al. ..... 399/254 X

FOREIGN PATENT DOCUMENTS

| | | |
|---|---|---|
| JP | 05-297714 | 11/1993 |
| JP | 06-157185 | 6/1994 |
| JP | 07-199628 | 8/1995 |
| JP | 08-141216 | 6/1996 |
| JP | 09-242805 | 9/1997 |
| JP | 09-242806 | 9/1997 |
| JP | 10-003219 | 1/1998 |

* cited by examiner

*Primary Examiner* — Sandra Brase
(74) *Attorney, Agent, or Firm* — Stanzione & Kim, LLP

(57) ABSTRACT

A developing apparatus and an image forming apparatus including the developing apparatus, the developing apparatus including a developing roller, a mixing transfer unit including a first mixing transfer unit and a second mixing transfer unit, and an auxiliary mixing transfer unit disposed on a transfer path from the first mixing transfer unit to the second mixing transfer unit and to mix the developer transferred by the first mixing transfer unit and the supply toner, wherein the auxiliary mixing transfer unit includes a vertical transfer unit to vertically upward transfer the developer transferred by the first mixing transfer unit and a mixing unit to mix the developer transferred by the first mixing transfer unit and the supply toner injected from an upper side thereof and to connect the second mixing transfer unit to a through hole formed in a lower portion thereof.

28 Claims, 12 Drawing Sheets

DEVELOPING APPARATUS AND IMAGE FORMING APPARATUS INCLUDING THE SAME

CROSS-REFERENCE TO RELATED APPLICATIONS

This application claims the benefit of priority under 35 U.S.C. §119 to Japanese Patent Application No. 2009-295940, filed on Dec. 25, 2009, in the Japanese Patent Office, and Korean Patent Application No. 10-2010-0069607, filed on Jul. 19, 2010, in the Korean Intellectual Property Office, the disclosures of which are incorporated herein in their entirety by reference.

BACKGROUND

1. Field of the Invention

The present general inventive concept relates to a developing apparatus and an image forming apparatus including the developing apparatus, and more particularly to a binary developing apparatus in electrophotography that includes a unit for mixing and supplying supply toner and a developer, and an image forming apparatus including the binary developing apparatus.

2. Description of the Related Art

The conventional binary developing apparatus that uses a developer formed of toner and carrier are illustrated in FIGS. 1A and 1B. The conventional binary developing apparatus includes a developing roller 15 for supplying toner so as to develop an electrostatic latent image formed on a photosensitive drum 10, a first mixing unit 14 for supplying the developer to the developing roller 15, a second mixing unit 16 for mixing the developer transferred from the first mixing unit 14 and supply toner supplied by a supply unit 22 through a supply path 20 of a toner supply unit (not shown), and transferring the mixture of the developer and the supply toner to the first mixing unit 14.

Around the photosensitive drum 10 are a charging roller 12 for charging an outer circumferential surface of the photosensitive drum 10, an exposure apparatus 13 for exposing the charged outer circumferential surface of the photosensitive drum 10, and a cleaning blade 17 for transferring a toner image on the photosensitive drum 10 onto a transfer belt 30 and removing the toner remaining in the photosensitive drum 10. A transfer roller 40 is disposed facing the photosensitive drum 10, with the transfer belt 30 passing therebetween.

The toner is consumed and the carrier is reused in a developing region where the photosensitive drum 10 and the developing roller 15 face each other. To supply the toner consumed in the developing region, the conventional binary developing apparatus previously measures a quantity of toner used for printing by using a bit counter or measures a density thereof by using a toner density sensor (not shown), and supplies a toner shortage from the toner supply unit 22.

As multifunctional printers or printers have been recently digitized, apparatuses for forming an image by using digital exposure apparatuses, such as laser scanners or LED heads, are most popular. Thus, a temporal quantity of consumed toner can be estimated by calculating a digital value corresponding to a quantity of printing. However, the actual quantity of consumed toner varies according to an environment where the toner or electrophotographic drum is being used. Further, the toner supply unit is a machine part and a supply quantity thereof varies, and thus it is necessary to check a quantity of toner supplied to the toner density sensor. The toner density sensor measures a density of the carrier near the toner density sensor by using a permeability sensor. The toner density sensor does not measure the density of toner but measures a quantity of remaining carrier.

Further, the toner supply unit includes a supply roller of which a shaft has a groove via which a toner may pass to quantitatively supply the toner. The supply toner supplied from the toner supply unit is injected into the developer of the developing apparatus when binary particles of the supply toners cohere since toners in a toner tank are frictionally charged to opposite polarities thereof or cohere on their own or due to pressure. The toner particles injected into the developer are charged onto and attached to the surface of the carrier of the developer. During this process, each toner is properly charged and attached to the surface of the carrier. Thus, the toner particles can be developed.

A quantity of the developer used has been recently reduced, owing to a small-size developing apparatus. In particular, it is now possible to maintain an image density by using a small quantity of the developer since a high quality pigment is added to the toner, owing to the high quality and low cost, and smaller particles of the carrier.

However, the conventional binary developing apparatus needs a time for mixing the developer since it is necessary to precisely measure a quantity of consumed toner, inject the toner into the carrier, and mix, charge, and distribute the toner injected into the carrier. A short time for mixing the developer results in insufficiently charging the toner, and transferring the toner that is not held onto the surface of the carrier to the developing region. To increase the time for mixing the developer, a spare stirring chamber (not shown) is further installed (for example, see patent document 1).

[Patent Document 1] Japanese Patent Laid-Open Publication No. Hei 9-325612

However, the developing device of patent document 1 has a problem of an increased size since the developing device includes the developing tank and a spare stirring chamber. Further, a developer is formed of a carrier of powders that apply a resin coating onto the surface of ferrite or magnetite and a toner having resin as a main component. Thus, when the toner and the carrier are mixed together while the developer is currently flowing, since a weight of the flowing developer differs from that of developer contained in the developing apparatus, as illustrated in FIG. 2, supply toner $T_{add}$ supplied from a toner supply unit is not blended in developer D, and thus the supply toner $T_{add}$ that is insufficiently charged and distributed is transferred to a developing region. Therefore, an image quality decreases, and an image is contaminated or the inside of the developer is contaminated. In particular, a high speed developer of A4 size has a shorter mixing time by about 25% than that of a developer of A3 size, and thus the conventional developer does not achieve a high-speed mixing time.

SUMMARY

The present general inventive concept provides a newly improved developing apparatus capable of efficiently supplying supply toner to a developer and charging the supply toner, and an image forming apparatus including the developing apparatus.

Additional aspects and utilities of the present general inventive concept will be set forth in part in the description which follows and, in part, will be obvious from the description, or may be learned by practice of the present general inventive concept.

The present general inventive concept can be realized by providing a developing apparatus including a developing roller disposed facing a photosensitive drum on which an electrostatic latent image is formed, and to supply a developer, formed of carrier and toner and attached to an outer circumferential surface of the developing roller to the photosensitive drum, a mixing transfer unit disposed facing the developing roller, and comprising a first mixing transfer unit to supply the developer to the developing roller, and a second mixing transfer unit to mix the developer transferred by the first mixing transfer unit and a supply toner and to transfer the mixture to the first mixing transfer unit, and an auxiliary mixing transfer unit disposed on a transfer path from the first mixing transfer unit to the second mixing transfer unit, and to mix the developer transferred by the first mixing transfer unit and the supply toner, wherein the auxiliary mixing transfer unit includes a vertical transfer unit to vertically upward transfer the developer transferred by the first mixing transfer unit, and a mixing unit to mix the developer transferred by the first mixing transfer unit and the supply toner injected from an upper side of the mixing unit and to connect the second mixing transfer unit to a through hole formed in a lower portion of the mixing unit.

A transfer performance of the developer may increase in the order of the first mixing transfer unit, the vertical transfer unit, and the mixing unit, and the mixing unit and the second mixing transfer unit may have the same transfer performance.

The developing apparatus may include a toner supply unit installed on the upper side of the mixing unit to supply the supply toner.

The developing apparatus may include a toner density sensor disposed on a transfer path of the first mixing transfer unit to detect a density of the toner, wherein the toner supply unit supplies the supply toner based on a detection result of the toner density detection unit.

The developing apparatus may include a consumed toner quantity estimation unit to estimate a quantity of toner consumed by the photosensitive drum based on an exposure region used to expose the electrostatic latent image formed on the outer circumferential surface of the photosensitive drum and an exposure density and a toner density sensor to detect a density of toner on a transfer path of the second mixing transfer unit, wherein the toner supply unit determines a quantity of the supply toner based on a detection result of the toner density detection unit and an estimation result of the consumed toner quantity estimation unit.

The vertical transfer unit and the mixing unit included in the auxiliary mixing transfer unit may be disposed in parallel to each other.

The vertical transfer unit and the mixing unit included in the auxiliary mixing transfer unit may be disposed in a concentric circle.

The present general inventive concept may also be realized by providing an image forming apparatus including a photosensitive drum having an outer circumferential surface on which an electrostatic latent image is formed and a developing apparatus for developing the electrostatic latent image formed on the outer circumferential surface of the photosensitive drum, wherein the developing apparatus includes a developing roller disposed facing the photosensitive drum on which the electrostatic latent image is formed, and to supply a developer, formed of carrier and toner and attached to an outer circumferential surface of the developing roller, to the photosensitive drum, a mixing transfer unit disposed facing the developing roller, and comprising a first mixing transfer unit to supply the developer to the developing roller and a second mixing transfer unit to mix the developer transferred by the first mixing transfer unit and supply toner and to transfer the mixture to the first mixing transfer unit, and an auxiliary mixing transfer unit disposed on a transfer path from the first mixing transfer unit to the second mixing transfer unit and to mix the developer transferred by the first mixing transfer unit and the supply toner, wherein the auxiliary mixing transfer unit includes a vertical transfer unit to vertically upward transfer the developer transferred by the first mixing transfer unit, and a mixing unit to mix the developer transferred by the first mixing transfer unit and the supply toner injected from an upper side of the mixing unit and to connect the second mixing transfer unit to a through hole formed in a lower portion the mixing unit.

Features and/or utilities of the present general inventive concept may also be realized by a developing apparatus including a mixing transfer unit to transfer a developer to a developing roller, the mixing transfer unit including a first mixing transfer unit and a second mixing transfer unit connected to the first mixing transfer unit, an auxiliary mixing transfer unit disposed in a path from the first mixing transfer unit to the second mixing transfer unit, the auxiliary mixing transfer unit including a vertical transfer unit to lift the developer from the first mixing transfer unit and a mixing unit to receive, in a upper portion of the mixing unit, the developer from the vertical transfer unit and a supply toner, to mix the developer and the supply toner, and to transfer the mixture through a lower portion of the mixing unit to the second mixing transfer unit.

The auxiliary mixing transfer unit may be disposed above the mixing transfer unit.

A first end portion of the first mixing transfer unit may be connected to the second mixing transfer unit and a second end portion of the first mixing transfer unit may be connected to the auxiliary mixing transfer unit.

The developing apparatus may include a toner supply unit disposed above the mixing unit, and to supply the supply toner.

The developing apparatus may include a toner density sensor disposed on a transfer path of the first mixing unit, and to detect a density of toner, wherein the toner supply unit supplies the supply toner based on a detection result of the toner density sensor.

The developing apparatus may include a consumed toner quantity estimation unit to estimate a quantity of toner consumed and a toner density detecting unit to detect a density of toner on a transfer path of the second mixing transfer unit, wherein the toner supply unit determines a quantity of the supply toner based on a detection result of the toner density detection unit and an estimation result of the consumed toner quantity estimation unit.

The vertical transfer unit may be disposed in an inside portion of the mixing unit.

The vertical transfer unit may include a screw to lift the developer from the first mixing transfer unit.

The auxiliary mixing transfer unit may include a connection unit formed in an inclined direction to transfer the developer from the vertical transfer unit to the upper portion of the mixing unit.

The mixing unit may include a first through hole disposed in the upper portion of the mixing unit to receive the developer from the vertical transfer unit, an opening unit disposed in the upper portion of the mixing unit to receive the supply toner, and a second through hole disposed in the lower portion of the mixing unit to transfer the mixture to the second mixing transfer unit.

The mixing unit may include at least one mixing member to mix the developer and the supply toner, wherein each respective mixing member includes a rotational shaft and at least one paddle.

The mixing unit may include a first mixing chamber including a first mixing member, and to receive, in an upper portion of the first mixing chamber, the developer from the vertical transfer unit and the supply toner and a second mixing chamber connected to the first mixing chamber and including a second mixing member, and to transfer the mixture through a lower portion of the second mixing chamber to the second mixing transfer unit.

The mixing member may include at least one support unit, wherein each respective support unit is connected to a corresponding rotational shaft and a corresponding paddle.

The mixing unit may have a height between 50 and 70 millimeters.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1A:
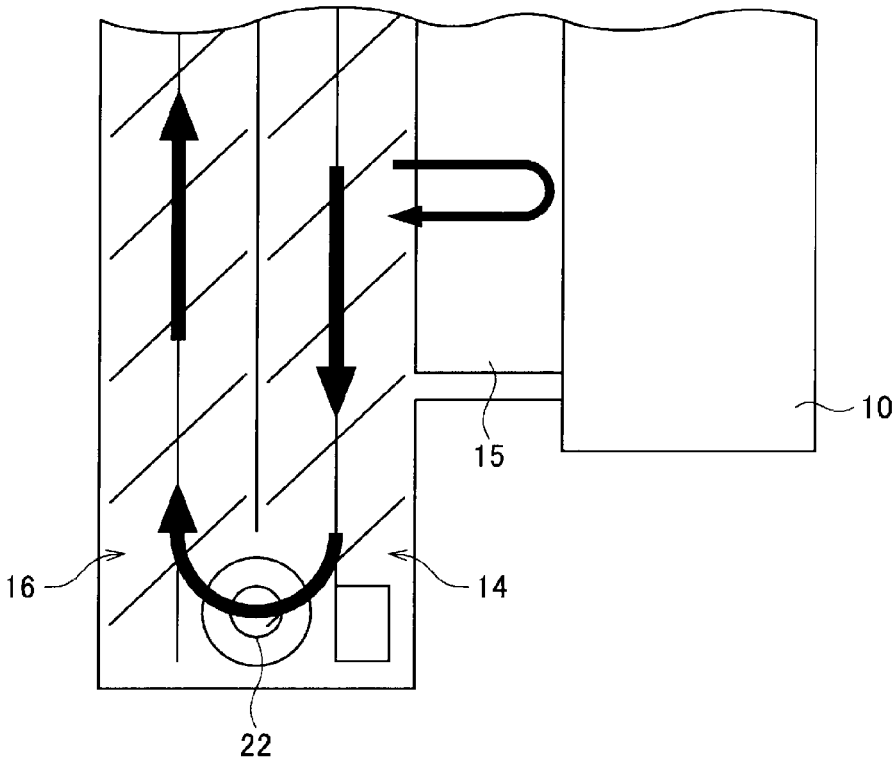
FIG. 1A (RELATED ART)
FIG. 1A is a schematic partial plan view of a conventional developing apparatus.
Figure 1B:
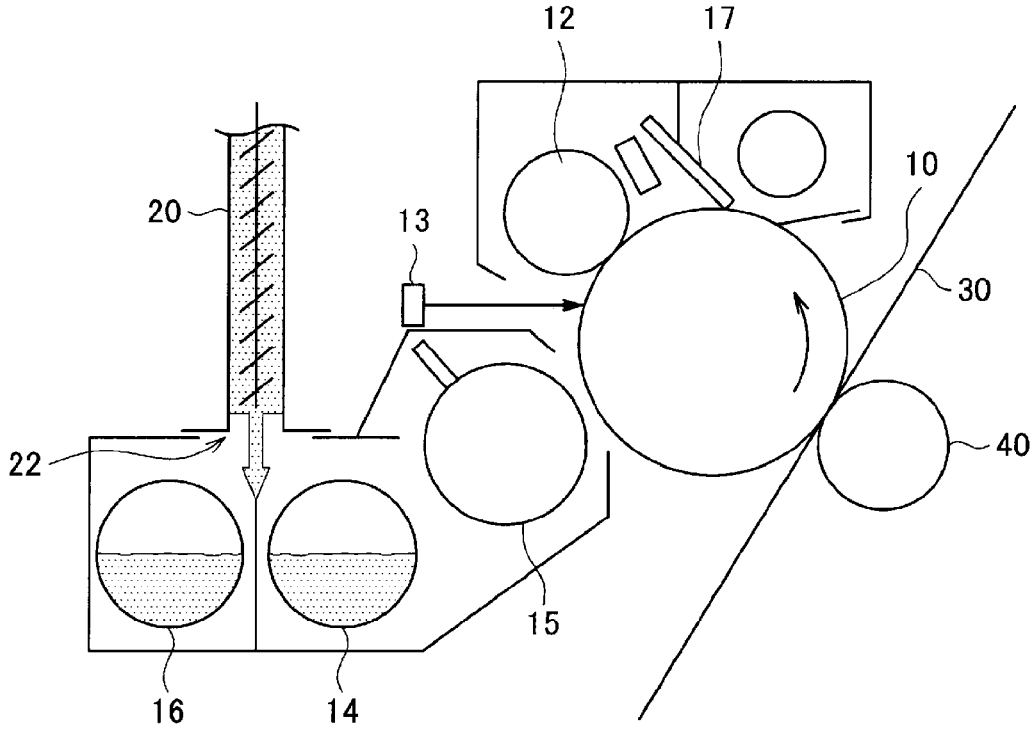
FIG. 1B (RELATED ART)
FIG. 1B is a schematic side view of the conventional developing apparatus.
Figure 2:
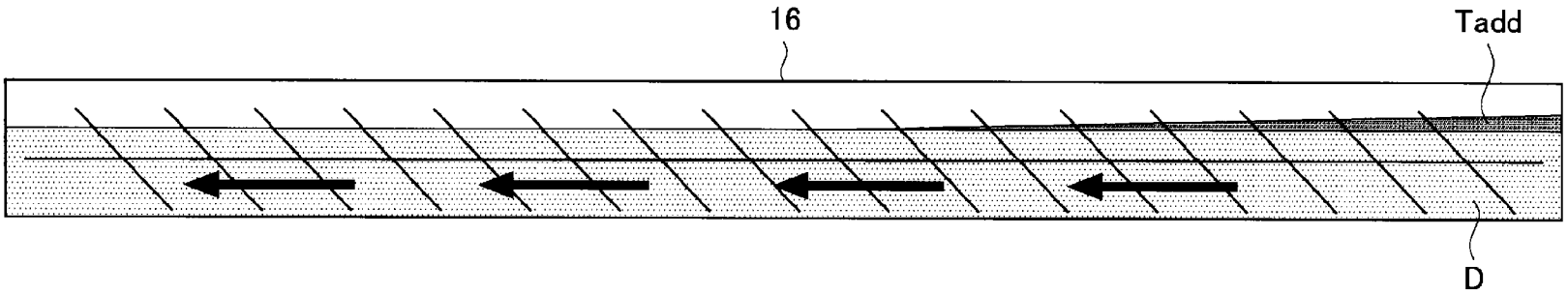
FIG. 2 (RELATED ART)
FIG. 2 illustrates a status of a conventional mixture of a supply toner and a developer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
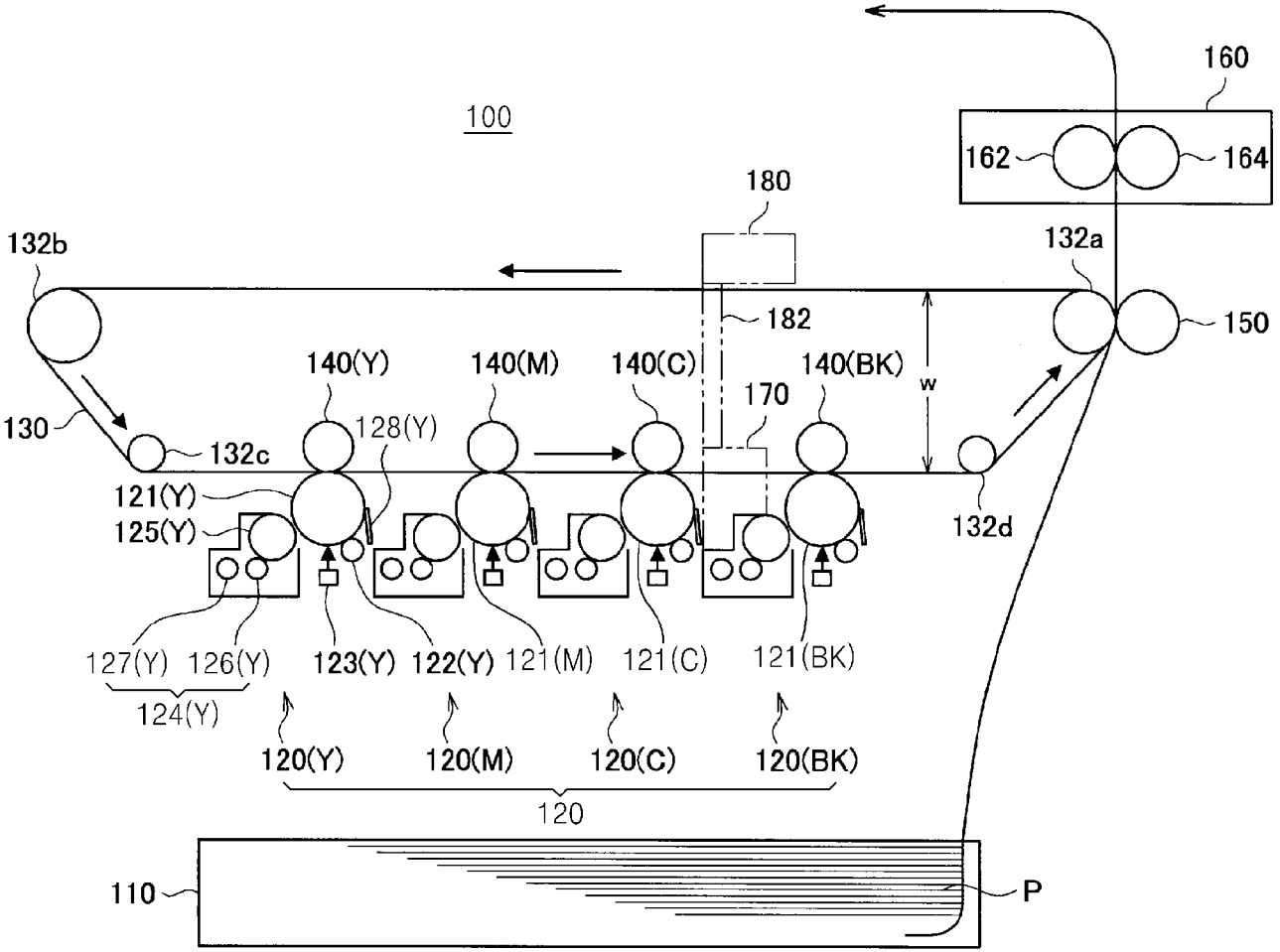
FIG. 3 is a schematic side view of an image forming apparatus according to an embodiment of the present general inventive concept.

FIG. 3 is a schematic side view of an image forming apparatus 100 according to an embodiment of the present general inventive concept. Referring to FIG. 3, the image forming apparatus 100 may be applied to, for example, a laser printer, a copier, or a facsimile machine, and forms an image by secondarily transferring a primarily transferred toner image onto a paper P over a transfer belt 130 supported by four rollers 132*a*, 132*b*, 132*c*, and 132*d*. The image forming apparatus 100 includes a paper supply unit 110, an image forming unit 120, and a fixing unit 160.

The paper supply unit 110 stores the paper P for transferring the toner image formed by the image forming unit 120 and supplies the paper P to a transfer roller 150.

The image forming unit 120 forms the toner image transferred onto the paper P, and includes, for example, four image forming units 120BK, 120C, 120M, and 120Y for forming toner images of four colors (black, cyan, magenta, and yellow). The four image forming units 120BK, 120C, 120M, and 120Y include the same construction.

For example, the yellow image forming unit 120Y includes a photosensitive drum 121Y on which an electrostatic latent image is formed, a charging roller 122Y for charging an outer circumferential surface of the photosensitive drum 121Y, and an exposure apparatus 123Y for exposing the charged outer circumferential surface of the photosensitive drum 121Y and forming the electrostatic latent image. Further, the yellow image forming unit 120Y includes a mixing transfer unit 124Y including a first mixing transfer unit 126Y and a second mixing transfer unit 127Y for mixing toner that is a developer, a developing roller 125Y for adhering toner supplied from the first mixing transfer unit 126Y to the electrostatic latent image formed on the photosensitive drum 121Y and forming the toner image, and a cleaning blade 128Y for removing the toner remaining in the photosensitive drum 121Y after transferring the toner image onto the transfer belt 130.

Four transfer rollers 140BK, 140C, 140M, and 140Y to transfer the toner image onto the transfer belt 130 are disposed, respectively, facing photosensitive drums 121BK, 121C, 121M, and 121Y, with the transfer belt 130 therebetween.

In addition, an auxiliary mixing transfer unit 170 to efficiently mix and transferring supply toner supplied from a toner supply unit 180 through a supply path 182 and the developer is disposed between the first mixing transfer unit 126Y and the second mixing transfer unit 127Y of the image forming unit 120 of the present embodiment. The auxiliary mixing transfer unit 170 will be described in detail later.

The image forming apparatus 100 forms a full color toner image by generating a toner image of each color by using the image forming unit 120 according to image data, sequentially transferring the toner images onto the transfer belt 130 that is an intermediate transfer member, and overlapping the toner images. A secondary transfer unit including the transfer roller 150 and a support roller 132*a* collectively transfers the full color toner image onto the paper P extracted from the paper supply unit 110. The paper P onto which the full color toner image is transferred to the fixing unit 160. The full color toner image is fixed to the paper P by the fixing unit 160 according to heat or pressure from rollers 162 and 164. Meanwhile, the toner remaining on the transfer belt 130 is removed by a cleaner (not shown) after the secondary transfer unit transfers the full color toner image onto the paper P.

As described above, the image forming apparatus 100 of the present embodiment includes the auxiliary mixing transfer unit 170 to supply the toner between the first mixing transfer unit 126Y and the second mixing transfer unit 127Y of a developing unit to develop the electrostatic latent image formed on the photosensitive drum 121, thereby efficiently mixing and transferring the supply toner supplied from the toner supply unit 180 and the developer flowing the first mixing transfer unit 126Y and the second mixing transfer unit 127Y.

The construction of a developing apparatus according to an embodiment of the present general inventive concept will be described with reference to FIGS. 4 through 7.

Figure 4:
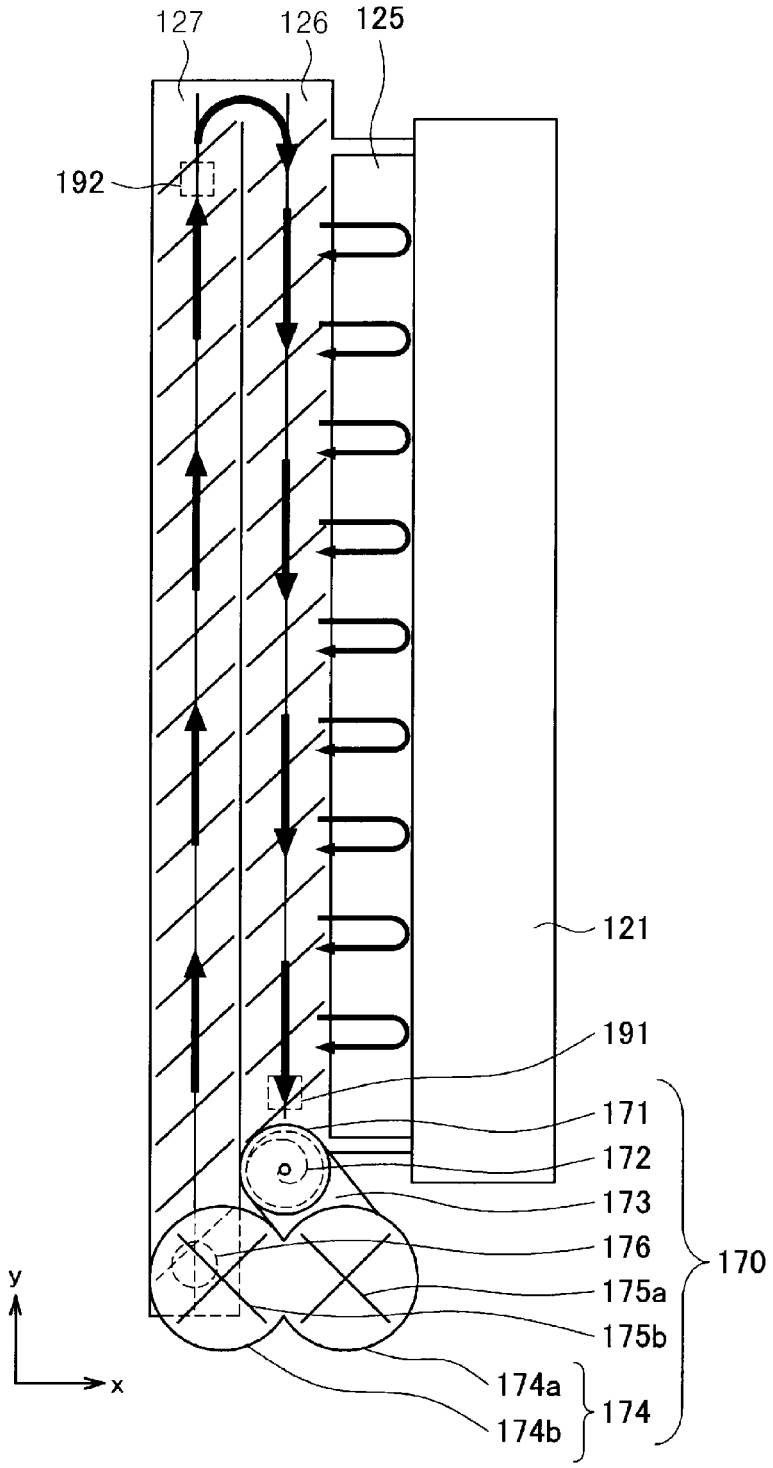
FIG. 4 is a schematic plan view of a developing apparatus including an auxiliary mixing transfer unit according to an embodiment of the present general inventive concept.
Figure 5:
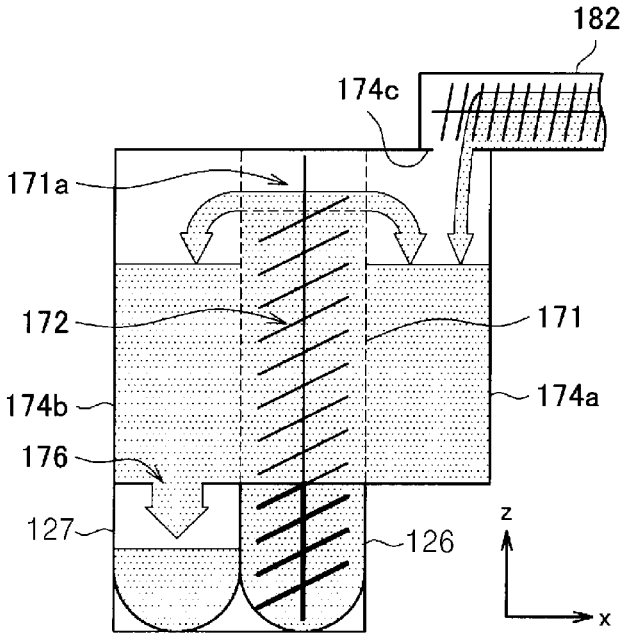
FIG. 5 is a side view of the auxiliary mixing transfer unit of FIG. 4.
Figure 6:
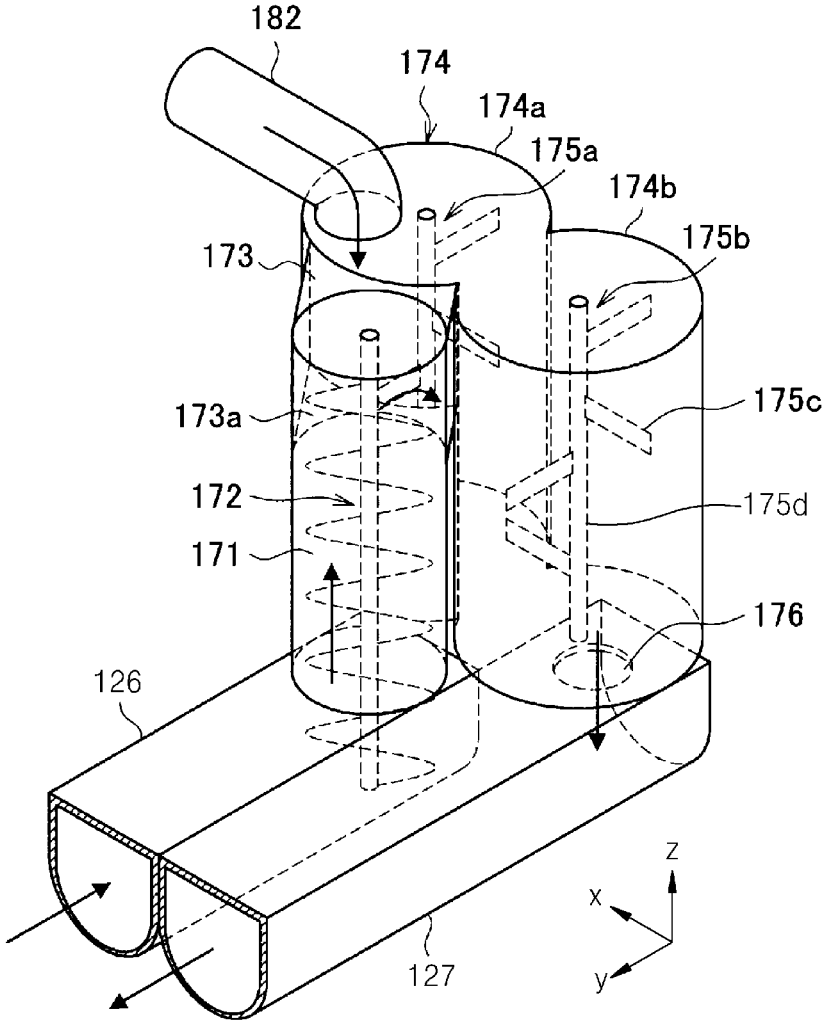
FIG. 6 is a perspective view of the auxiliary mixing transfer unit of FIG. 4.
Figure 7:
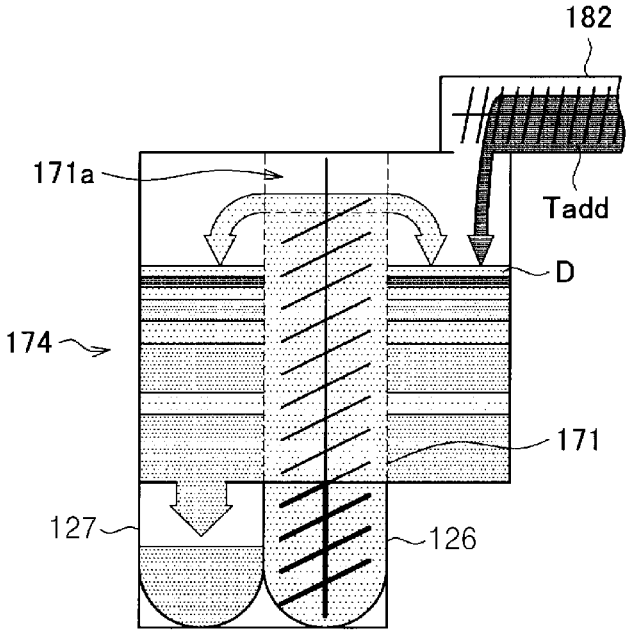
FIG. 7 illustrates a status of toner and a developer are mixed in the auxiliary mixing transfer unit illustrated in FIG. 4.

FIG. 4 is a schematic plan view of a developing apparatus including the auxiliary mixing transfer unit 170, according to an exemplary embodiment of the present general inventive concept. FIG. 5 is a side view of the auxiliary mixing transfer unit 170. FIG. 6 is a perspective view of the auxiliary mixing transfer unit 170. FIG. 7 illustrates a status of toner and a developer mixed in the auxiliary mixing transfer unit 170.

Referring to FIGS. 4 and 5, the developing apparatus includes a developing roller 125 to transfer toner and to supply the toner to the photosensitive drum 121 in a developing region that faces the photosensitive drum 121. The developing roller 125 may be, for example, a magnet roller that includes a fixing magnet and can rotate a nonmagnetic sleeve for holding a developer on the surface thereof. The developing apparatus includes a first mixing transfer unit 126 to supply a mixed developer to the developing roller 125, and the second mixing transfer unit 127 to mix the developer transferred by the first mixing transfer unit 126 and supply toner supplied from the toner supply unit 180 and to transfer the mixture to the first mixing transfer unit 126. Screws that are transfer wings are disposed in respective support axes of transfer paths of the first mixing transfer unit 126 and the second mixing transfer unit 127. The developer is transferred by rotating the screws. The developing apparatus of the present embodiment includes the auxiliary mixing transfer unit 170 between a transfer path of the first mixing transfer unit 126 and the second mixing transfer unit 127 through which the developer is transferred from the first mixing transfer unit 126 to the second mixing transfer unit 127.

Referring to FIG. 6, the auxiliary mixing transfer unit 170 includes a vertical transfer unit 171 to vertically upward transfer the developer transferred from the first mixing transfer unit 126, and a mixing unit 174 to mix the developer transferred by the vertical transfer unit 171 and the supply toner supplied from the toner supply unit 180 and to discharge the mixture to the second mixing transfer unit 127.

The vertical transfer unit 171 is a tubular member extending in a z-axis direction, as shown in FIGS. 5 and 6, and is connected to the transfer path of the first mixing transfer unit 126 to transfer the developer disposed in the top end portion in a -y direction of the first mixing transfer unit 126 extending in a horizontal direction (a y-axis direction). The screws 172 are installed in the vertical transfer unit 171 to vertically upward transfer the developer. A through hole 171*a* is formed in the outer circumferential surface of the top side of the vertical transfer unit 171. The inner spaces of the vertical transfer unit 171 and the mixing unit 174 are connected to each other by a connection unit 173.

The connection unit 173 may be, for example a hollow member to connect the inner spaces of the vertical transfer unit 171 and the mixing unit 174 in an approximately horizontal direction (in a direction approximately perpendicular to the z-axis direction). A bottom surface 173*a* of the connection unit 173 may be inclined toward a first mixing chamber 174*a* from the vertical transfer unit 171. Thus, the developer transferred upward by the vertical transfer unit 171 may easily move to the first mixing chamber 174*a*.

The mixing unit 174 includes the first mixing chamber 174*a* and a second mixing chamber 174*b*. The first mixing chamber 174*a* and the second mixing chamber 174*b* may be, for example, tubular members extending in the z-axis direction, and cross each other in the x-axis direction. The insides of the first mixing chamber 174*a* and the second mixing chamber 174*b* are connected to each other in a portion where the first mixing chamber 174*a* and the second mixing chamber 174*b* cross each other so that the developer can move to the insides of the first mixing chamber 174*a* and the second mixing chamber 174*b*.

Mixing members 175*a* and 175*b* to mix the developer and toner are disposed in the first mixing chamber 174*a* and the second mixing chamber 174*b*, respectively. The mixing members 175*a* and 175*b* may be configured, for example, as plate-type paddles 175*c* disposed in an axial direction at a predetermined angle gap (for example, 90°) from a rotation shaft 175*d* extending in the z-axis direction. Rotation of the rotation shaft 175*d* enables mixing the developer and toner contained in the mixing unit 174 by using the paddles 175*c*.

The through hole 171*a* is formed in the outer circumferential surface of the top side of the first mixing chamber 174*a* so that the inner spaces of the first mixing chamber 174*a* and the vertical transfer unit 171 are connected to each other by the connection unit 173. An opening unit 174*c* is formed in the top surface of the first mixing chamber 174*a* so that the inside of the mixing unit 174 and the supply path 182 through which the supply toner is transferred from the toner supply unit 180 are connected to each other. Thus, the supply toner is supplied from the upper side of the first mixing chamber 174*a* through the supply path 182 of the toner supply unit 180. Meanwhile, a through hole 176 is formed in the bottom surface of the second mixing chamber 174*b* to connect the second mixing chamber 174*b* with the transfer path of the second mixing transfer unit 127.

As described above, the auxiliary mixing transfer unit 170 vertically upward transfers the developer transferred from the first mixing transfer unit 126 by using the screws 172 of the vertical transfer unit 171 and drops the developer from the through hole 171*a* of the first mixing chamber 174*a* to the inner space of the first mixing chamber 174*a* through the connection unit 173. Meanwhile, the supply toner supplied through the supply path 182 of the toner supply unit 180 drops from the top side of the first mixing chamber 174*a* to the inner space of the first mixing chamber 174*a*. The mixing members 175*a* and 175*b* installed in the first mixing chamber 174*a* and the second mixing chamber 174*b* mix the developer and the supply toner. The mixed developer and supply toner drop from the through hole 176 formed in the bottom surface of the second mixing chamber 174*b* to the transfer path of the second mixing transfer unit 127.

In more detail, the auxiliary mixing transfer unit 170 of the present embodiment can supply the sufficiently mixed toner to the mixing transfer unit 124 by utilizing the gravity locomotive power of the developer, compared to the conventional toner supply unit. Therefore, although the mixing unit 174 is designed to supply the developer to the developing roller 125 or a layer regulation member so as to achieve a high speed and small-size mixing unit, it is possible to distribute toner to the surface of the carrier and maintain a proper quantity of charging. In particular, if the height of the auxiliary mixing transfer unit 170 in a vertical direction (the z-axis direction) is about 50 mm through about 70 mm, it is possible to obtain a quantity of the developer equal to one axis portion of the conventional mixing apparatus, thereby realizing a small developing region.

A space above the transfer belt 130 of a ring shape is a dead space so that the auxiliary mixing transfer unit 170 can be installed in the image forming apparatus 100 without increasing the width w of the image forming apparatus 100. The length of the mixing unit 174 in the x direction ranges from the length between the first mixing transfer unit 126 and the second mixing transfer unit 127 in the x direction to the length between the developing roller 125 to the second mixing transfer unit 127 in the x direction so that the auxiliary mixing transfer unit 170 can be installed in the image forming apparatus 100 without increasing the width w of the image forming apparatus 100.

In this regard, the transfer performance of the developer increases in the order of the first mixing transfer unit 126, the vertical transfer unit 171, and the mixing unit 174 so that the first mixing transfer unit 126 continuously flows the developer to the vertical transfer unit 171, the mixing unit 174, and the second mixing transfer unit 127. The transfer performance of the mixing unit 174 and the second mixing transfer unit 127 may be approximately the same.

In the auxiliary mixing transfer unit 170 of the present embodiment, the toner supply unit 180 is installed in the top side of the first mixing chamber 174*a*. Thus, a developer D transferred by the vertical transfer unit 171 and a supply toner $T_{add}$ supplied from the toner supply unit 180 can be deposited and injected into the mixing chamber 174 as shown in FIG. 7. Therefore, the mixing members 175*a* and 175*b* of the mixing unit 174 can efficiently mix the supply toner $T_{add}$ and the developer D that are forcibly separated by a difference in gravity between the supply toner $T_{add}$ and the developer D, thereby efficiently distributing the supply toner $T_{add}$ to the developer D and charging the supply toner $T_{add}$.

A quantity of the supply toner $T_{add}$ supplied from the toner supply unit 180 may be determined, for example, based on a detection result of a toner density sensor 191 of FIG. 4, which is installed at a downstream of a transfer direction of the transfer path of the first mixing transfer unit 126. The toner density sensor 191 can detect the density of toner remaining in the developer after the toner is consumed to develop an electrostatic latent image. Thereafter, the toner supply unit 180 supplies the supply toner $T_{add}$ and a quantity of toner that are to be contained in the developer.

Alternatively, the quantity of the supply toner $T_{add}$ supplied from the toner supply unit 180 may be determined based on a detection result of a toner density sensor 192 of FIG. 4, which is installed at a downstream of a transfer direction of the transfer path of the second mixing transfer unit 127. A quantity of toner consumed to develop the electrostatic latent image may be estimated by a consumed toner quantity estimation unit (not shown) based on an exposure region and/or an exposure intensity of an exposure apparatus. The quantity of toner supplied by the toner supply unit 180 may be approximately the same as the quantity of toner consumed to develop the electrostatic latent image estimated by the consumed toner quantity estimation unit. However, as described above, the estimated quantity of toner and the actually consumed quantity of toner differ according to an environment where the toner is used. Therefore, the quantity of toner estimated by the consumed toner quantity estimation unit is corrected to the density of toner detected by the toner density sensor 192 so as to more precisely supply the supply toner $T_{add}$.

As described above regarding the construction and function of an exemplary embodiment of the auxiliary mixing transfer unit 170, the auxiliary mixing transfer unit 170 of the image forming apparatus 100 is capable of efficiently distributing the supply toner $T_{add}$ to the developer D and charging the supply toner $T_{add}$. Thus, the high speed and small-size mixing unit image forming apparatus 100 can be realized.

Next, an auxiliary mixing transfer unit 270 according to another exemplary embodiment of the present general inventive concept will be described with reference to FIGS. 8A, 8B, and 9. The auxiliary mixing transfer unit 270 of the present embodiment may replace the auxiliary mixing transfer unit 170 of the developing apparatus of the image forming apparatus 100 of the previous embodiment.

Figure 8A:
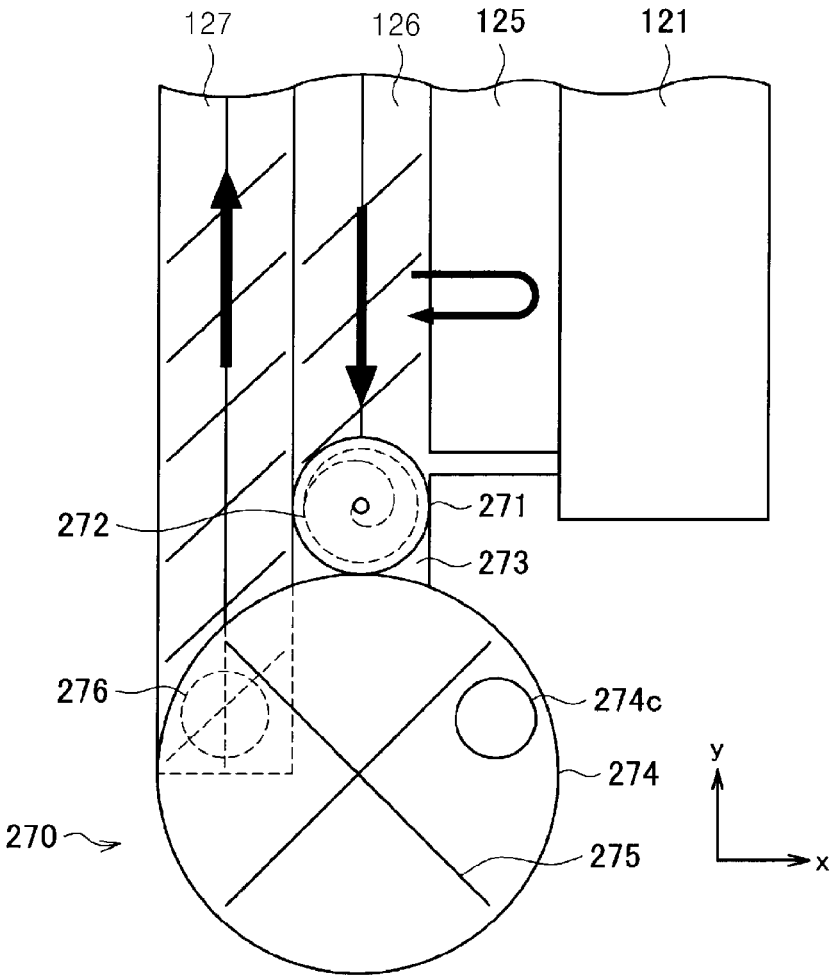
FIG. 8A is a schematic plan view of an auxiliary mixing transfer unit according to another embodiment of the present general inventive concept.

FIG. 8A is a schematic plan view of the auxiliary mixing transfer unit 270 according to another embodiment of the present general inventive concept. FIG. 8B is a side view of the auxiliary mixing transfer unit 270. FIG. 9 is a perspective view of the auxiliary mixing transfer unit 270.

Figure 8B:
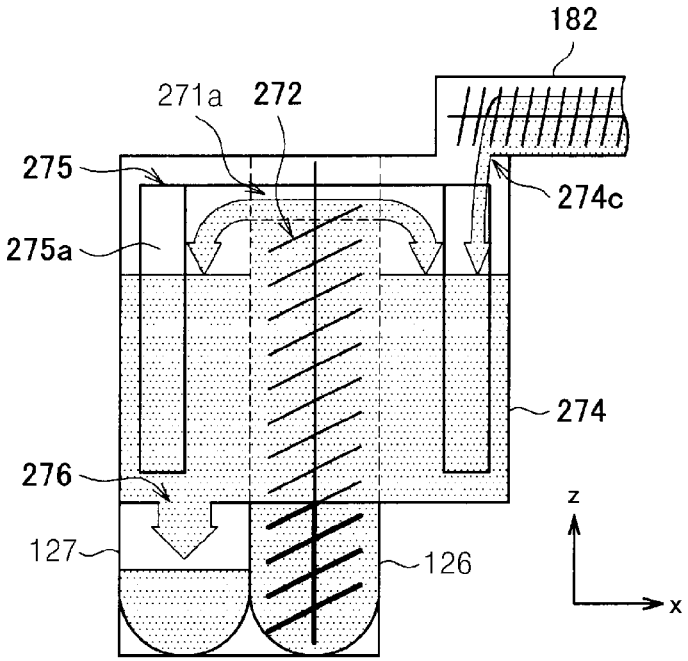
FIG. 8B is a side view of the auxiliary mixing transfer unit of FIG. 8A.
Figure 9:
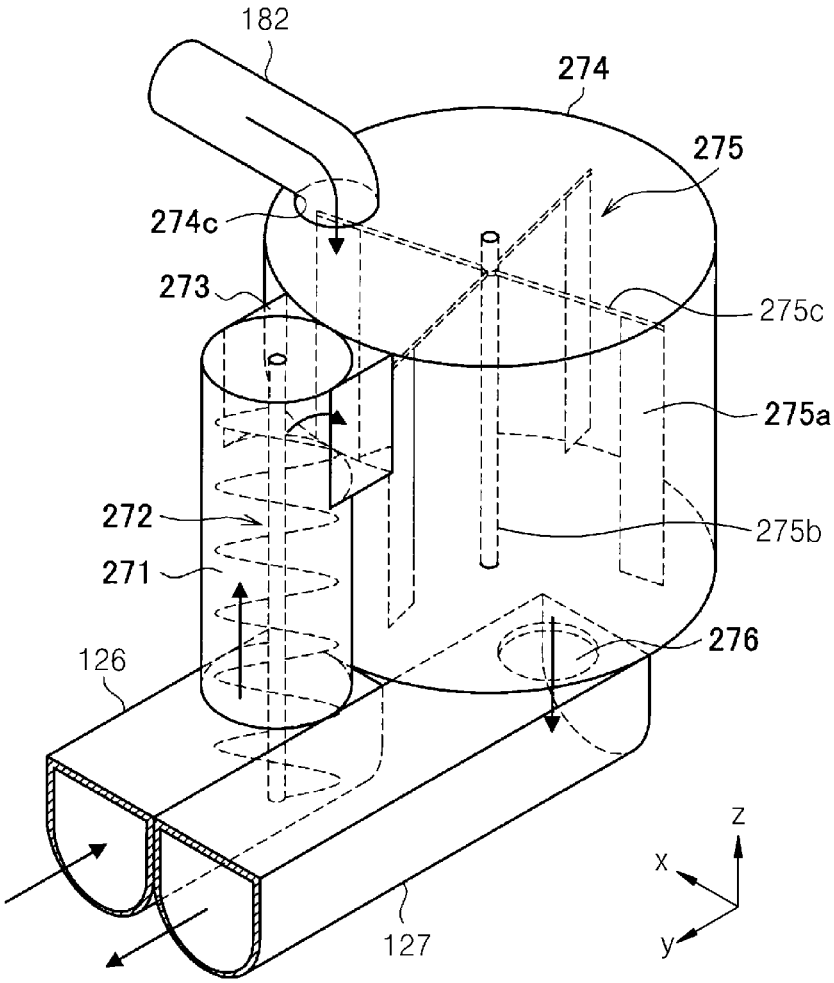
FIG. 9 is a perspective view of the auxiliary mixing transfer unit of FIG. 8B.

Like the auxiliary mixing transfer unit 170 of the previous embodiment, referring to FIGS. 8A and 8B, the auxiliary mixing transfer unit 270 of the present embodiment is disposed between the transfer paths of the first mixing transfer unit 126 and the second mixing transfer unit 127 through which a developer is transferred from the first mixing transfer unit 126 to the second mixing transfer unit 127. The auxiliary mixing transfer unit 270 includes a vertical transfer unit 271 to vertically upward transfer the developer transferred from the first mixing transfer unit 126, and a mixing unit 274 to mix the developer transferred by the vertical transfer unit 271 and the supply toner supplied from the toner supply unit 180 and discharging the mixture to the second mixing transfer unit 127.

Like the vertical transfer unit 171 of the previous embodiment, the vertical transfer unit 271 may be, for example, a tubular member extending in a z-axis direction, and is connected to the transfer path of the first mixing transfer unit 126 to transfer the developer disposed in the top end portion in a -y direction of the first mixing transfer unit 126 extending in a horizontal direction (a y-axis direction). Screws 272 are installed in the vertical transfer unit 271 to vertically upward transfer the developer. A through hole 271*a* is formed in the outer circumferential surface of the top side of the vertical transfer unit 271. The inner spaces of the vertical transfer unit 271 and the mixing unit 274 are connected to each other by a connection unit 273.

The mixing unit 274 may be, for example, a tubular member extending in a z-axis direction, and may include a mixing member 275 for mixing the developer and toner. Referring to FIG. 9, the mixing member 275 of the present embodiment is configured to include four board-type members 275*a* extending vertically downward, respectively, from four support units 275*c* extending from a rotation shaft 275*b* to a diameter direction. Rotation of the rotation shaft 275*b* results in rotations of the four board-type member 275*a* around the rotation shaft 275*b*, thereby mixing the developer and toner contained in the mixing unit 174.

The through hole 271*a* is formed in the outer circumferential surface of the top side of the first unit 274 so that the inner space of the mixing unit 274 is connected to the inner space of the vertical transfer unit 271 by the connection unit 273. An opening unit 274*c* is formed in the top surface of the mixing unit 274 so that the inner space of the mixing unit 274 and the supply path 182 of the toner supply unit 180 are connected to each other. Thus, the supply toner from the toner supply unit 180 is supplied from the upper side of the mixing unit 274. Meanwhile, a through hole 276 is formed in the bottom surface of the mixing unit 274 to connect the mixing unit 274 with the transfer path of the second mixing transfer unit 127.

As described above, the auxiliary mixing transfer unit 270 vertically upward transfers the developer transferred from the first mixing transfer unit 126 by using the screws 272 of the vertical transfer unit 271 and drops the developer from the through hole 271*a* of the mixing unit 274 to the inner space of the mixing unit 274 through the connection unit 273. Meanwhile, the supply toner supplied from the toner supply unit 180 drops from the top side of the mixing unit 274 to the inner space of the mixing unit 274. The mixing chamber 275 installed in the mixing unit 274 mixes the developer and the supply toner. The mixed developer and supply toner drop from the through hole 276 formed in the bottom surface of the mixing unit 274 to the transfer path of the second mixing transfer unit 127.

The auxiliary mixing transfer unit 270 of the present embodiment can supply the sufficiently mixed toner to the first mixing transfer unit 126 and the second mixing transfer unit 127 by utilizing the gravity locomotive power of the developer. Further, the toner supply unit 180 is installed in the top side of the mixing unit 274, and thus, a developer D transferred by the vertical transfer unit 271 and a supply toner $T_{add}$ supplied from the toner supply unit 180 can be deposited and injected into the mixing unit 274. Therefore, the mixing member 275 of the mixing unit 274 can efficiently mix the supply toner $T_{add}$ and the developer D that are forcibly separated by a difference in gravity between the supply toner $T_{add}$ and the developer D, thereby efficiently distributing the supply toner $T_{add}$ to the developer D and charging the supply toner $T_{add}$.

As described above regarding the construction and function of the auxiliary mixing transfer unit 270, the auxiliary mixing transfer unit 270 of the developing apparatus enables to efficiently distribute the supply toner $T_{add}$ to the developer D and charge the supply toner $T_{add}$. Thus, the high speed and small-size mixing unit image forming apparatus 100 can be realized.

Next, an auxiliary mixing transfer unit 370 according to another embodiment of the present general inventive concept will now be described with reference to FIG. 10.

Figure 10:
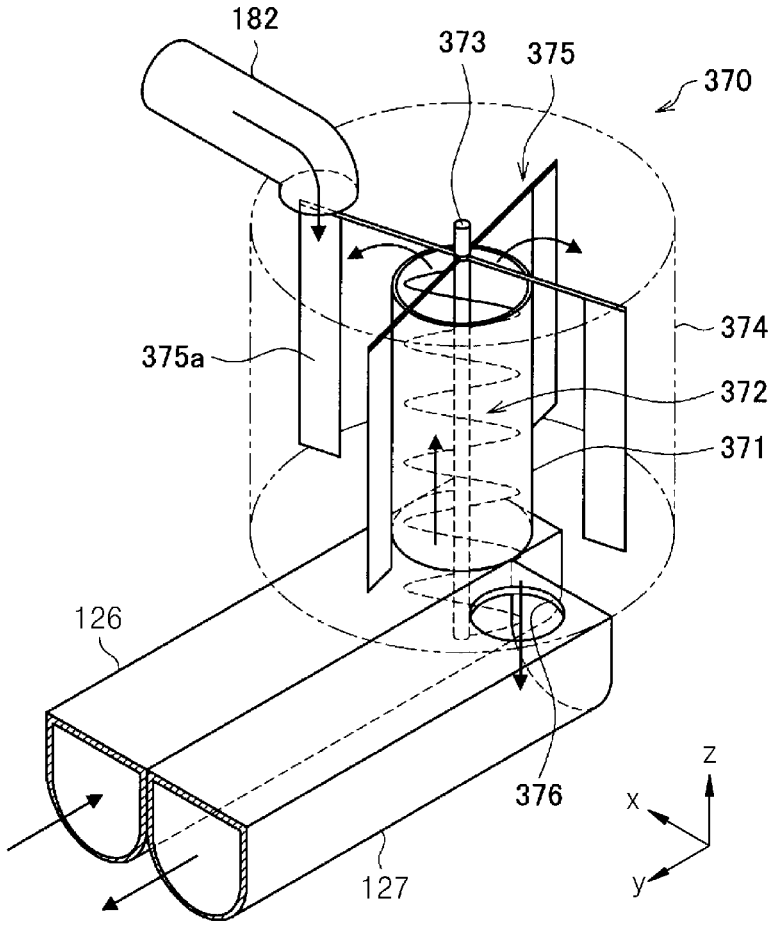
FIG. 10 is a perspective view of an auxiliary mixing transfer unit according to another embodiment of the present general inventive concept.

FIG. 10 is a perspective view of the auxiliary mixing transfer unit 370 according to another embodiment of the present general inventive concept.

Referring to FIG. 10, a vertical transfer unit 371 to vertically upward transfer a developer transferred by the first mixing transfer unit 126 is installed in a mixing unit 374 for mixing the developer and supply toner. Board-type mixing wings 375*a* for mixing the developer and supply toner injected into the mixing unit 374 are disposed on a rotation shaft 373 of a screw 372 that is installed in the vertical transfer unit 371 and vertically upward transfers the developer. Thus, the screw 372 and the mixing wings 375*a* can rotate by a single shaft.

If the screw 372 of the vertical transfer unit 371 vertically upward transfers the developer transferred by the first mixing transfer unit 126, the developer overflows in the upper end of the vertical transfer unit 371, and drops to a mixing space formed by the outer circumferential surface of the vertical transfer unit 371 and the inner circumferential surface of the mixing unit 274. Meanwhile, the supply toner drops from the toner supply unit 180 installed on the top side of the mixing space. A mixing member 375 installed in the mixing space of the mixing unit 374 mixes the developer and the supply toner. The mixed developer and supply toner drops from a through hole 376 formed in the bottom surface of the mixing unit 374 to a transfer path of the second mixing transfer unit 127.

In this case, the auxiliary mixing transfer unit 370 of the present embodiment can supply the sufficiently mixed toner to the first mixing transfer unit 126 and the second mixing transfer unit 127 by utilizing the gravity locomotive power of the developer. Further, the toner supply unit 180 is installed on the top side of the mixing unit 374, and thus, the developer transferred by the vertical transfer unit 371 and the supply toner supplied from the toner supply unit 180 can be deposited and injected into the mixing unit 374. Therefore, the mixing member 375 of the mixing unit 374 can efficiently mix the supply toner and the developer that are forcibly separated by a difference in gravity between the supply toner and the developer, thereby efficiently distributing the supply toner to the developer and charging the supply toner.

While the present general inventive concept has been particularly illustrated and described with reference to exemplary embodiments thereof, it will be understood by those skilled in the art that various changes in form and details may be made therein without departing from the spirit and scope of the general inventive concept as defined by the appended claims.

For example, in the above-described embodiments, the shapes of the mixing members 175*a*, 175*b*, 275, and 375 are paddles installed to a rotation shaft or board-type members extending vertically downward, but the present general inventive concept is not limited to the above-described shapes, and the mixing members 175*a*, 175*b*, 275, and 375 may mix a developer and supply toner injected into a mixing unit.

Further, in the above-described embodiments, the shapes of the vertical transfer units 171, 271, and 371 and the mixing units 174, 274, and 374 are circular, but the present general inventive concept is not limited to these shapes, and the vertical transfer units 171, 271, and 371 and the mixing units 174, 274, and 374 may be shaped, for example, hollow pillar members that may transfer a developer.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A developing apparatus comprising:

a developing roller disposed facing a photosensitive drum on which an electrostatic latent image is formed, and to supply a developer, formed of carrier and toner and attached to an outer circumferential surface of the developing roller, to the photosensitive drum;

a mixing transfer unit disposed facing the developing roller, and comprising:

a first mixing transfer unit to supply the developer to the developing roller; and a second mixing transfer unit to mix the developer transferred by the first mixing transfer unit and a supply toner and to transfer the mixture to the first mixing transfer unit; and an auxiliary mixing transfer unit disposed on a transfer path from the first mixing transfer unit to the second mixing transfer unit, and to mix the developer transferred by the first mixing transfer unit and the supply toner, wherein the auxiliary mixing transfer unit comprises:

a vertical transfer unit to vertically upward transfer the developer transferred by the first mixing transfer unit; and a mixing unit to mix the developer transferred by the first mixing transfer unit and the supply toner injected from an upper side of the mixing unit and to connect the second mixing transfer unit to a through hole formed in a lower portion of the mixing unit.

2. The developing apparatus of claim 1, wherein a transfer performance of the developer increases in the order of the first mixing transfer unit, the vertical transfer unit, and the mixing unit, and the mixing unit and the second mixing transfer unit have the same transfer performance.

3. The developing apparatus of claim 1 or 2, further comprising:

a toner supply unit installed on the upper side of the mixing unit, and to supply the supply toner.

4. The developing apparatus of claim 3, further comprising:

a toner density sensor disposed on a transfer path of the first mixing transfer unit, and to detect a density of toner, wherein the toner supply unit supplies the supply toner based on a detection result of the toner density detection unit.

5. The developing apparatus of claim 3, further comprising:

a consumed toner quantity estimation unit to estimate a quantity of toner consumed by the photosensitive drum based on an exposure region used to expose the electrostatic latent image formed on the outer circumferential surface of the photosensitive drum and an exposure density; and a toner density sensor to detect a density of toner on a transfer path of the second mixing transfer unit, wherein the toner supply unit determines a quantity of the supply toner based on a detection result of the toner density detection unit and an estimation result of the consumed toner quantity estimation unit.

6. The developing apparatus of claim 1, wherein the vertical transfer unit and the mixing unit included in the auxiliary mixing transfer unit are disposed in parallel to each other.

7. The developing apparatus of claim 1, wherein the vertical transfer unit and the mixing unit included in the auxiliary mixing transfer unit are disposed in a concentric circle.

8. An image forming apparatus comprising:

a photosensitive drum having an outer circumferential surface on which an electrostatic latent image is formed; and a developing apparatus for developing the electrostatic latent image formed on the outer circumferential surface of the photosensitive drum, wherein the developing apparatus comprises:

a developing roller disposed facing the photosensitive drum on which the electrostatic latent image is formed, and to supply a developer, formed of carrier and toner and attached to an outer circumferential surface of the developing roller, to the photosensitive drum;

a mixing transfer unit disposed facing the developing roller, and comprising:

a first mixing transfer unit to supply the developer to the developing roller; and a second mixing transfer unit to mix the developer transferred by the first mixing transfer unit and supply toner and to transfer the mixture to the first mixing transfer unit; and an auxiliary mixing transfer unit disposed on a transfer path from the first mixing transfer unit to the second mixing transfer unit and to mix the developer transferred by the first mixing transfer unit and the supply toner, wherein the auxiliary mixing transfer unit comprises:

a vertical transfer unit to vertically upward transfer the developer transferred by the first mixing transfer unit; and a mixing unit to mix the developer transferred by the first mixing transfer unit and the supply toner injected from an upper side of the mixing unit and to connect the second mixing transfer unit to a through hole formed in a lower portion of the mixing unit.

9. The image forming apparatus of claim 8, wherein the transfer performance of the developer increases in the order of the first mixing transfer unit, the vertical transfer unit, and the mixing unit, and the mixing unit and the second mixing transfer unit have the same transfer performance.

10. The image forming apparatus of claim 8 or 9, further comprising:

a toner supply unit installed in the upper side of the mixing unit, and to supply the supply toner.

11. The image forming apparatus of claim 10, further comprising:

a toner density sensor disposed on a transfer path of the first mixing unit, and to detect a density of toner, wherein the toner supply unit supplies the supply toner based on a detection result of the toner density sensor.

12. The image forming apparatus of claim 10, further comprising:

a consumed toner quantity estimation unit to estimate a quantity of toner consumed by the photosensitive drum based on an exposure region used to expose the electrostatic latent image formed on the outer circumferential surface of the photosensitive drum and an exposure density; and a toner density detecting unit to detect the density of toner on a transfer path of the second mixing transfer unit, wherein the toner supply unit determines a quantity of the supply toner based on a detection result of the toner density detection unit and an estimation result of the consumed toner quantity estimation unit.

13. The image forming apparatus of claim 8, wherein the vertical transfer unit and the mixing unit included in the auxiliary mixing transfer unit are disposed in parallel to each other.

14. The image forming apparatus of claim 8, wherein the vertical transfer unit and the mixing unit included in the auxiliary mixing transfer unit are disposed in a concentric circle.

15. A developing apparatus comprising:

a mixing transfer unit to transfer a developer to a developing roller, the mixing transfer unit comprising:

a first mixing transfer unit; and a second mixing transfer unit connected to the first mixing transfer unit; and an auxiliary mixing transfer unit disposed in a path from the first mixing transfer unit to the second mixing transfer unit, the auxiliary mixing transfer unit comprising:

a vertical transfer unit to lift the developer from the first mixing transfer unit; and a mixing unit to receive, in a upper portion of the mixing unit, the developer from the vertical transfer unit and a supply toner, to mix the developer and the supply toner, and to transfer the mixture through a lower portion of the mixing unit to the second mixing transfer unit.

16. The developing apparatus of claim 15, wherein the auxiliary mixing transfer unit is disposed above the mixing transfer unit.

17. The developing apparatus of claim 15, wherein a first end portion of the first mixing transfer unit is connected to the second mixing transfer unit and a second end portion of the first mixing transfer unit is connected to the auxiliary mixing transfer unit.

18. The developing apparatus of claim 15, further comprising:

a toner supply unit disposed above the mixing unit, and to supply the supply toner.

19. The developing apparatus of claim 18, further comprising:

a toner density sensor disposed on a transfer path of the first mixing unit, and to detect a density of toner, wherein the toner supply unit supplies the supply toner based on a detection result of the toner density sensor.

20. The developing apparatus of claim 18, further comprising:

a consumed toner quantity estimation unit to estimate a quantity of toner consumed; and a toner density detecting unit to detect a density of toner on a transfer path of the second mixing transfer unit, wherein the toner supply unit determines a quantity of the supply toner based on a detection result of the toner density detection unit and an estimation result of the consumed toner quantity estimation unit.

21. The developing apparatus of claim 15, wherein the vertical transfer unit is disposed in an inside portion of the mixing unit.

22. The developing apparatus of claim 15, wherein the vertical transfer unit comprises:

a screw to lift the developer from the first mixing transfer unit.

23. The developing apparatus of claim 15, wherein the auxiliary mixing transfer unit comprises:

a connection unit formed in an inclined direction to transfer the developer from the vertical transfer unit to the upper portion of the mixing unit.

24. The developing apparatus of claim 15, wherein the mixing unit comprises:

a first through hole disposed in the upper portion of the mixing unit to receive the developer from the vertical transfer unit;

an opening unit disposed in the upper portion of the mixing unit to receive the supply toner; and a second through hole disposed in the lower portion of the mixing unit to transfer the mixture to the second mixing transfer unit.

25. The developing apparatus of claim 15, wherein the mixing unit comprises:

at least one mixing member to mix the developer and the supply toner, wherein each respective mixing member includes a rotational shaft and at least one paddle.

26. The developing apparatus of claim 25, wherein the mixing unit comprises:

a first mixing chamber including a first mixing member, and to receive, in an upper portion of the first mixing chamber, the developer from the vertical transfer unit and the supply toner; and a second mixing chamber connected to the first mixing chamber and including a second mixing member, and to transfer the mixture through a lower portion of the second mixing chamber to the second mixing transfer unit.

27. The developing apparatus of claim 25, wherein the mixing member comprises:

at least one support unit, wherein each respective support unit is connected to a corresponding rotational shaft and a corresponding paddle.

28. The developing apparatus of claim 15, wherein the mixing unit has a height between 50 and 70 millimeters.

* * * * *